US012655751B2

(12) United States Patent
Seabrook et al.

(10) Patent No.: US 12,655,751 B2
(45) Date of Patent: Jun. 16, 2026

(54) SYSTEM AND METHOD FOR INJECTOR WARM-BACK TIME OPTIMIZATION FOR ZONAL ALLOCATION IN RESERVOIRS

(71) Applicant: ExxonMobil Technology and Engineering Company, Spring, TX (US)

(72) Inventors: Brian C. Seabrook, Houston, TX (US); Mohamed Adil Thankayathil, Kerala (IN)

(73) Assignee: ExxonMobil Technology and Engineering Company, Spring, TX (US)

( * ) Notice: Subject to any disclaimer, the term of this patent is extended or adjusted under 35 U.S.C. 154(b) by 521 days.

(21) Appl. No.: 18/322,338

(22) Filed: May 23, 2023

(65) Prior Publication Data

US 2024/0026775 A1 Jan. 25, 2024

Related U.S. Application Data

(60) Provisional application No. 63/368,810, filed on Jul. 19, 2022.

(51) Int. Cl.
*E21B 47/07* (2012.01)

(52) U.S. Cl.
CPC ..... *E21B 47/07* (2020.05)

(58) Field of Classification Search
None
See application file for complete search history.

(56) References Cited

U.S. PATENT DOCUMENTS

| | | | | |
|---|---|---|---|---|
| 2,739,475 | A * | 3/1956 | Nowak | E21B 47/103 73/152.05 |
| 3,709,032 | A * | 1/1973 | Coles, Jr. | E21B 47/103 73/152.13 |
| 4,832,121 | A * | 5/1989 | Anderson | E21B 43/26 166/308.1 |
| 2018/0016890 | A1* | 1/2018 | Friehauf | E21B 47/07 |
| 2019/0162065 | A1* | 5/2019 | Aslanian | G01N 15/082 |
| 2020/0190968 | A1* | 6/2020 | Lolla | E21B 47/047 |

* cited by examiner

*Primary Examiner* — Lina Cordero
(74) *Attorney, Agent, or Firm* — WOMBLE BOND DICKINSON (US) LLP; Kevin Davis

(57) ABSTRACT

Herein disclosed are methods and systems related to processes for injection wells generally utilized in the oil and gas industry. The methods herein include a method of estimating the relative cumulative volume of fluids injected into multiple zones of an injection well located in a hydrocarbon reservoir, the injection well including a plurality of zones. The method comprises injecting fluid into a wellbore of the injection well. The method further includes measuring temperature at points along the wellbore to produce a warm-back data set that includes data for a plurality of times and depths. The method also includes modifying an initial geotherm using only data from the warm-back data set that is in a middle-time region (MTR) of the warm-back data set to produce a calculated pseudo-geotherm. The calculated pseudo-geotherm may be used to estimate a volume of fluid injected into each of the plurality of zones.

23 Claims, 13 Drawing Sheets

1100

100A

100B

200

300

400

HEAT TRANSFER DURING MTR

500

600

700

800

900

1000

1100

SYSTEM AND METHOD FOR INJECTOR WARM-BACK TIME OPTIMIZATION FOR ZONAL ALLOCATION IN RESERVOIRS

CROSS-REFERENCE TO RELATED APPLICATION

This application claims the benefit of U.S. Provisional Application Ser. No. 63/368,810, entitled "System and Method for Injector Warm-Back Time Optimization for Zonal Allocation in Reservoirs," filed Jul. 19, 2022, the disclosure of which is hereby incorporated by reference in its entirety.

FIELD OF THE INVENTION

The present disclosure is related to processes for injection wells generally utilized in the oil and gas industry. Specifically, disclosed herein are methods and systems related to profiling and determining individual cumulative fluid injection profiles for an injection period for multiple zones of an injection well in single-reservoir or multi-reservoir systems.

BACKGROUND OF THE INVENTION

This section is intended to introduce various aspects of the art, which may be associated with exemplary embodiments of the present technological innovation. This discussion is believed to assist in providing a framework to facilitate a better understanding of particular aspects of the present technological innovation. Accordingly, it should be understood that this section should be read in this light, and not necessarily as admissions of prior art.

Injection wells are used to pump fluids at high pressure into underground strata in order to displace hydrocarbons, improve hydrocarbon recovery and to provide reservoir pressure support for nearby producer wells. In producing fields with a single reservoir, multiple reservoirs or multi-layered reservoirs, it is often economical to install a single injector well that can pump fluids into multiple pay zones at the same time.

A known method of injection profiling is performed by stopping injection into a well (a "shut-in period"). After fluid has been injected into the well for some time, the well is shut-in and a temperature probe is used to make temperature measurements along the length of the well. During the injection period, the fluid injected into the well spreads within the formation in which the well is disposed. The injection fluid typically lowers the temperature in the region of the wellbore and the zones of fluid injection can be identified using the temperature probe.

The temperature probe may take temperature measurements as it is moved through the wellbore. Using temperature values over time, an estimate of the amount of injection fluid dispersed in each zone may be made. This analysis is typically referred to as a warm-back analysis because the area surrounding the wellbore warms back to a steady state temperature, referred to as a "geotherm," over time. With the knowledge gained from the warm-back analysis, decisions may be made regarding how to modify the various zones of the well to optimize its performance.

As an alternative to getting temperature information with a probe, standalone temperature logging may be performed using permanently installed distributed temperature sensing (DTS) systems. Such DTS systems have been successfully used for zonal allocations in both deviated and vertical wells. DTS is a technique of monitoring temperature along the length of a wellbore using an optical waveguide, such as an optical fiber, as a temperature sensor.

In a typical DTS system, a laser or other light source at the surface of the well transmits a pulse of light into a fiber optic cable installed along the length of a well. Due to interactions with molecular vibrations within the glass of the fiber, a portion of the light is scattered back towards the surface (this phenomenon is referred to as Raman scattering, Brillouin scattering, and/or Rayleigh scattering, but will be generically referred to herein as "scattering"). DTS systems may be used to efficiently collect temperature along the length of a wellbore in a subsurface formation. For injection profiling, the temperature data may be analyzed to determine volumes of fluid that have been injected into the well so that an injection profile of the well may be developed.

Previous methods of analyzing warm-back temperature data to predict injection fluid volumes for various zones within a formation are subject to inaccuracies. An improved system and method for performing injection profiling using temperature data is desired.

SUMMARY OF THE INVENTION

An embodiment disclosed herein is a method of estimating the relative cumulative volume of fluids injected into multiple zones of an injection well located in a hydrocarbon reservoir. The method includes injecting fluid into a wellbore of the injection well. The method also includes measuring temperature at points along the wellbore, to produce a warm-back data set that includes data for a plurality of times and depths. The method further includes modifying an initial geotherm using only data from the warm-back data set that is in a middle-time region (MTR) of the warm-back data set to produce a calculated pseudo-geotherm. The method also includes estimating a volume of fluid injected into each of the plurality of zones based on the calculated pseudo-geotherm.

Another embodiment described herein provides a system for estimating a relative cumulative volume of fluids injected into multiple zones of an injection well located in a hydrocarbon reservoir, the injection well including a plurality of zones. The system includes an injection system that injects fluid into a wellbore of the injection well. The system also includes a temperature measurement system that measures temperature at points along the wellbore at a plurality of times and depths to create a warm-back data set. The system further includes a computing system that determines an initial geotherm based on the warm-back data set. The computing system also adjusts the initial geotherm using only data from the warm-back data set that is in a middle-time region (MTR) after injection of the fluid into the wellbore, resulting in a calculated pseudo-geotherm. The computing system further estimates a volume of fluid injected into each of the plurality of zones based on the initial geotherm (G) and the calculated pseudo-geotherm (G*).

Another embodiment described herein provides a computing system. The computing system includes a processor. The computing system also includes a non-transitory, computer-readable storage medium. The non-transitory, computer-readable storage medium includes code configured to direct the processor to determine an initial geotherm for a given depth and time, from a warm-back data set, with a rate of warm-back representative of an estimate of a relative cumulative volume of fluid injected into multiple zones of an injection well located in a hydrocarbon reservoir, the injection well including a plurality of zones, the warm-back data set being based on measured temperature at points along the wellbore at a plurality of times and depths. The non-transitory, computer-readable storage medium also includes code configured to direct the processor to adjust the initial geotherm using only data from the warm-back data set that represents a middle-time region after injection of the fluid into the wellbore, resulting in a calculated pseudo-geotherm. The non-transitory, computer-readable storage medium further includes code configured to direct the processor to estimate a volume of fluid injected into each of the plurality of zones based on the initial geotherm and the calculated pseudo-geotherm.

These and other features and attributes of the disclosed embodiments of the present techniques and their advantageous applications and/or uses will be apparent from the detailed description that follows.

BRIEF DESCRIPTION OF THE DRAWINGS

The advantages of the present techniques are better understood by referring to the following detailed description and the attached drawings, in which.

Figure 1A:
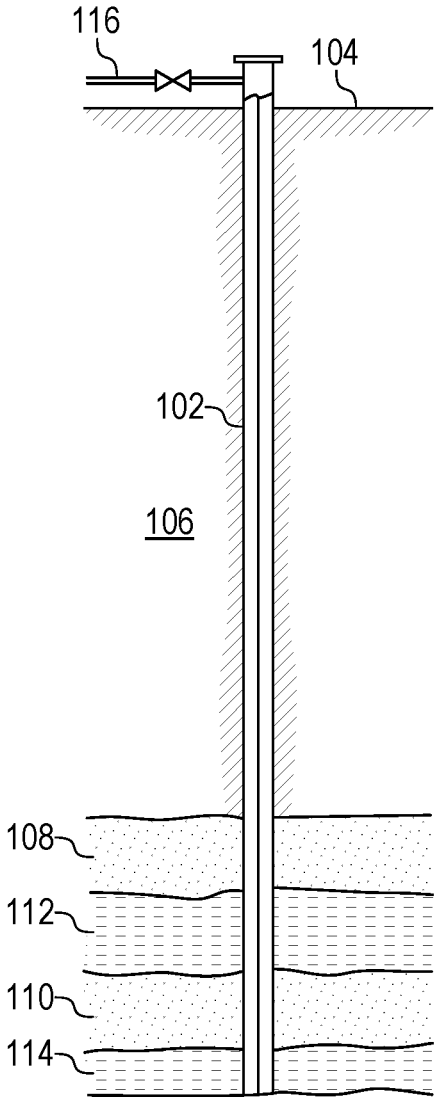
FIG. 1A is an illustration of a simplified view of an injection well illustrating exemplary layers of overburden, pay zones, and a relatively impermeable layer.

It should be noted that the figures are merely examples of the present techniques and are not intended to impose limitations on the scope of the present techniques. Further, the figures are generally not drawn to scale, but are drafted for purposes of convenience and clarity in illustrating various aspects of the techniques.

DETAILED DESCRIPTION OF THE INVENTION

In the following detailed description section, the specific examples of the present techniques are described in connection with preferred embodiments. However, to the extent that the following description is specific to a particular embodiment or a particular use of the present techniques, this is intended to be for exemplary purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition those skilled in the art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the singular forms "a," "an," and "the" mean one or more when applied to any embodiment described herein. The use of "a," "an," and/or "the" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the term "any" means one, some, or all of a specified entity or group of entities, indiscriminately of the quantity.

The phrase "at least one," when used in reference to a list of one or more entities (or elements), should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the phrase "based on" does not mean "based only on," unless expressly specified otherwise. In other words, the phrase "based on" means "based only on," "based at least on," and/or "based at least in part on."

As used herein, the terms "example," "exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure, or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "field" (sometimes referred to as an "oil and gas field" or a "hydrocarbon field") refers to an area for which hydrocarbon production operations are to be performed to provide for the extraction of hydrocarbon fluids from one or more corresponding subterranean formation.

The term "injection profiling," or "injection allocation" refers to the task of quantifying the volumes of fluid injected through the injection well into each of the underground reservoir zones. Accurate injection profiling enables one to ascertain whether or not fluids are being injected into all the desired intervals and at the optimum rates to enable improved extraction of hydrocarbons from the reservoirs. Accurate injection profiling is important, not only for optimizing hydrocarbon recovery, but also for long-term reservoir management. It enables operators to diagnose any losses in reservoir injectivity, build-up of skin, and near-wellbore fractures. It also enables evaluation of well performance along the length of the well and any identification of changes in the performance of the injection well over time. As a result, it may trigger operators to make configuration, operational or maintenance adjustments based on the determinations of the zonal injection volumes. Injection profiling can also influence important design considerations, such as, the design of subsurface completion, optimal well-placement, opening or closing of downhole interval control valves, chokes or sleeves, and optimization of injection well operating schedules.

The term "substantially," when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing strings and other equipment that is located inside the wellbore. Moreover, according to embodiments described herein, the terms "downhole" and "subsurface" are sometimes used interchangeably, although the term "downhole" is generally used to refer specifically to the inside of the wellbore.

The term "wellbore" refers to a borehole drilled into a subterranean formation. The borehole may include vertical, deviated, highly deviated, and/or horizontal sections. The term "wellbore" also includes the downhole equipment associated with the borehole, such as the casing strings, production tubing, gas lift valves, and other subsurface equipment. Relatedly, the term "hydrocarbon well" (or simply "well") includes the wellbore in addition to the wellhead and other associated surface equipment.

In a typical well evaluation technique known as the warm-back method, cold fluid is injected into a hotter reservoir, and the region near the wellbore cools down. When injection of the fluid ceases, the wellbore region slowly warms back to the far field geothermal temperature.

As an alternative to the warm-back method, injected fluid could potentially be warmer than the reservoir. Such a method would provide a cool-back to the geothermal temperature. It may be in this case that a long period of prior cold fluid injection has reduced the geothermal temperature relative to the original geothermal, such that the current injection fluid is warmer than the local current geothermal temperature. Whether the injection fluid is warmer or cooler than the reservoir, the measurement of the transient temperature profile and its return to the geothermal upon shut-in can be modeled to determine recent zonal injection allocation using the present technological innovation.

The processes and methods herein provide a new method for determining zonal flow rates from an injection well injecting into a multi-layer hydrocarbon reservoir using distributed temperature measurements that mitigates the limitations and issues of the prior art described above. Moreover, the proposed technological innovation may also optimize the shut-in period so that the desired information is obtained with the least amount of deferred production.

The present technological innovation contemplates fluid injection profiles for an injection period for multiple zones of an injection well in single-reservoir or multi-reservoir systems. Multi-reservoir systems include without limitation vertical wells.

A single reservoir may include a very long horizontal well where a concern is how much each lateral segment of the well injects when the well is divided up into segments (zones) even if the reservoir is somewhat homogeneous. Wellbore hydraulics and completion design may be optimized using the injection profile information to try and manage the injector well performance. But we do also wish to cover a multi-reservoir case (those likely but not exclusively being vertical wells in that case).

Figure 1B:
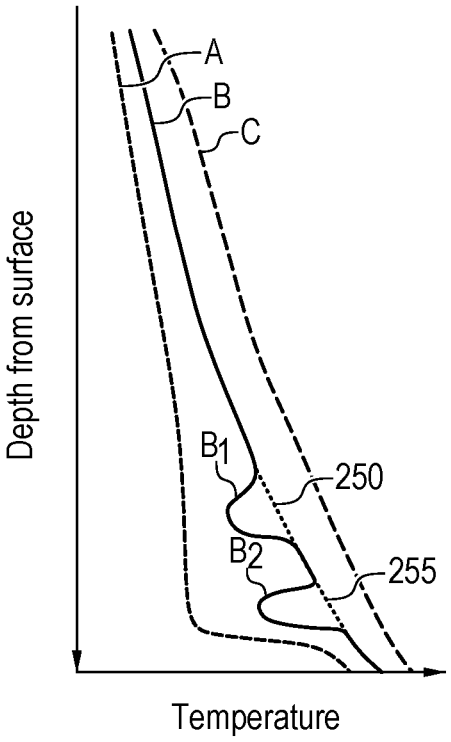
FIG. 1B is an illustration of a typical steady-state injection temperature profile, a shut-in temperature profile, and a reference temperature profile (geothermal temperature profile) for an injection well corresponding to the elevations and zones of FIG. 1A as pertains to a warm-back analysis method.

FIG. 1A together with FIG. 1B illustrate aspects of typical warm-back analysis. FIG. 1A, which is generally referred to by the reference number 100A, provides a simplified view of an injection well 102 which has been installed from the surface 104 through an overburden rock 106 through two pay zones (or "zones") 108 and 110 that are located in a hydrocarbon reservoir containing recoverable hydrocarbons. Zones 108 and 110 are also separated by a relatively (substantially) impermeable layer 112, such as shale rock. An impermeable layer 114 is disposed under the zone 110. The injection well 102 is connected to an injection network 116 which supplies an injection fluid to the injection well 102.

FIG. 1B, which is generally referred to by the reference number 100B, illustrates the various depth and temperature profiles involved in performing warm-back analysis for the injection well 102 shown in FIG. 1A. In FIG. 1B, Curve A illustrates a steady state injection temperature profile for the injection well 102 shown in FIG. 1A that may be detected using an appropriate temperature measurement technique that may include, but is not limited to, DTS, flux measurement, and production logging tools (PLT). Curve B illustrates a shut-in temperature profile that may be similarly measured. This shut-in temperature profile is typically taken when the well is shut-in following a period of steady injection corresponding to Curve A. Curve C illustrates the reference temperature profile, or geotherm, used in the warm-back analysis method calculations.

The geothermal temperature profile (Curve C) may be used as the reference temperature profile for any subsequent warm-back analysis calculations that may be conducted across the lifetime of the field. Inflection B1 in the shut-in temperature profile (Curve B) illustrates the lower temperature in the upper pay zone 108, while inflection B2 in the shut-in temperature profile illustrates the lower temperature in the lower pay zone 110. The extent of the inflections B1 and B2 are indicators of the cumulative injection volume taken by zones 108 and 110 in the preceding injection cycle—greater the extent of inflection, greater the total injected volume into that zone. Hereafter, inflections B1 and B2 may sometimes be referred to as "warm-back signatures" or "warm-back traces."

Figure 2:
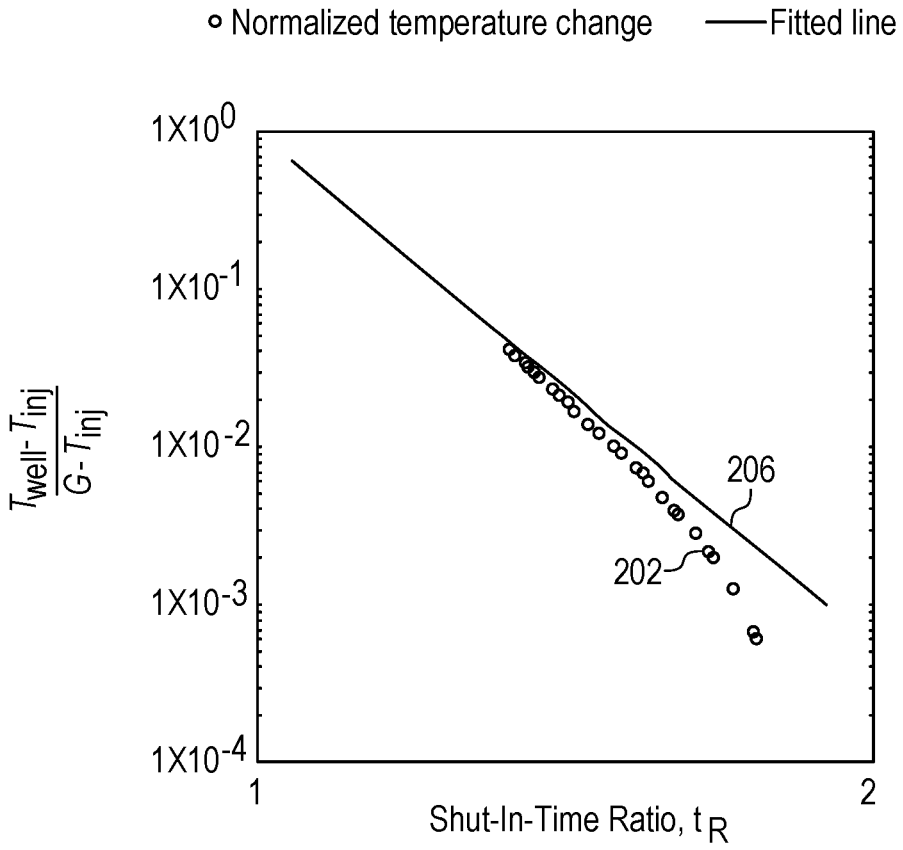
FIG. 2 is a graph showing an injector warm-back model using theoretical data, with an early-time region where adiabatic expansion occurs.

FIG. 2 is a graph showing an injector warm-back model using theoretical data, with an early-time region where adiabatic expansion occurs. The graph is generally referred to by the reference number 200.

The graph 200 includes a normalized temperature trace 202 and a fitted line 206. The fitted line 206 is a prediction of a warm-back trace according to equation (1), as explained below.

The model shown in FIG. 2 follows the following warm-back equation:

$$T_{well}=T_{inj}+(G-T_{inj})t_R^{-\beta} \qquad \text{Equation (1)}$$

where $T_{well}$ is a temperature at the wellbore (measured, e.g., by a DTS system), $T_{inj}$ is a temperature of injection fluid (e.g., water) injected into the wellbore (measured, e.g., by a DTS system at the time of fluid injection), G is a geothermal temperature, $t_R$ is a shut-in time ratio, and β is an exponential fitting parameter. In an exemplary embodiment of the present technological innovation, β is a lumped parameter having reservoir properties and volume of fluid injected.

The shut-in time ratio $t_R$ is defined as:

$$t_R=(1+t_{inj}/\Delta t)$$

where $t_{inj}$ is the time duration of injection prior to shut-in and Δt is the time elapsed.

The model represented in FIG. 2 assumes the parameter B, representing the relative rate of cooling of individual zones, to estimate the measure of fluid volume injected into that particular zone.

The normalized temperature trace 202 represents the temperature measured $T_w$ that is normalized with the temperature difference driving the warm-back, which may be expressed as $G-T_{inj}$. The early part of the normalized temperature trace 202, which is deviating from the straight line portion, is the area of adiabatic expansion (towards the bottom right part of the trace).

The model shown in FIG. 2 does not suggest a method for fitting the model to real data when the 1-D assumption no longer applies, such as during an early-time region and a late-time region. For example, the adiabatic temperature plot (early-time region) is non-linear in FIG. 2. This is a shortcoming in known methods of warm-back analysis.

Figure 3:
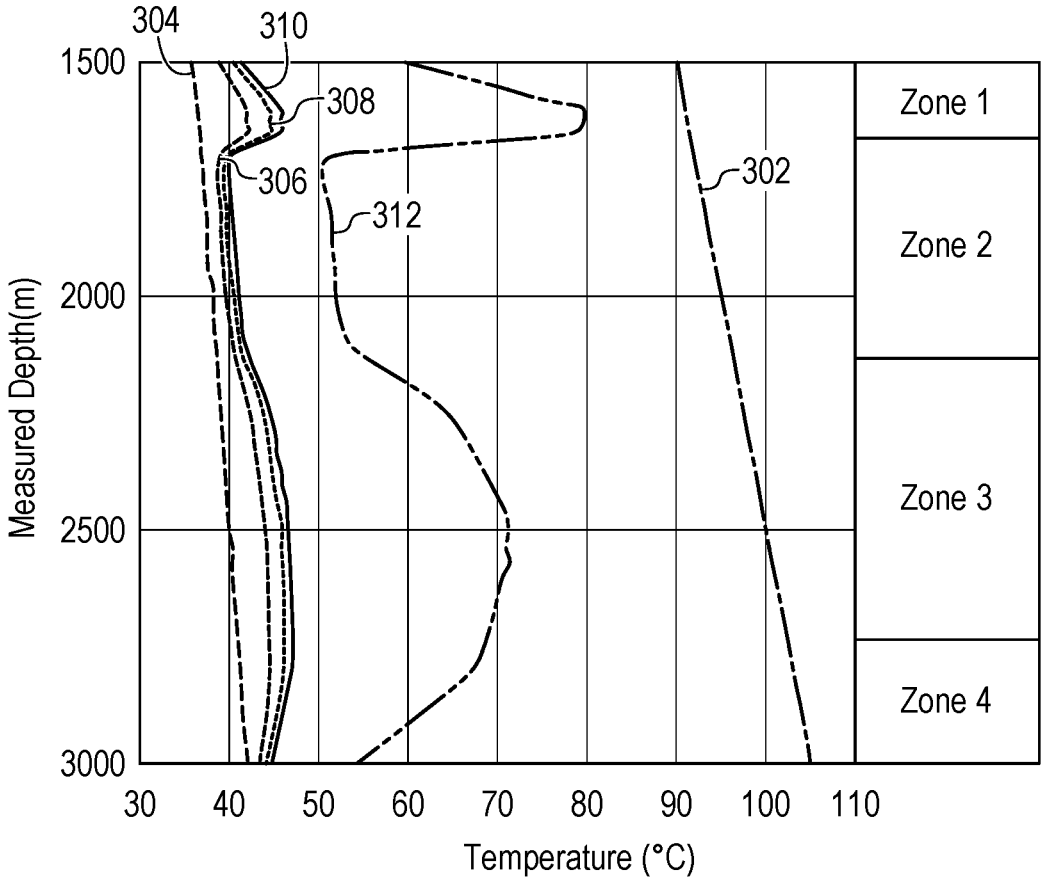
FIG. 3 is a graph showing an injector warm-back model according to the present technological innovation, with temperature plotted against measured depth.

FIG. 3 is a graph showing an injector warm-back model according to the present technological innovation, with temperature plotted against measured depth. The graph is generally referred to by the reference number 300. FIG. 3 shows four separate zones according to depth. The four zones are identified as Zone 1, Zone 2, Zone 3 and Zone 4 at the right side of FIG. 3. Zone 1 is shown at the shallowest depth and Zone 4 is shown at the deepest depth.

A geotherm line 302 indicates a relatively steady state temperature prior to injecting fluid into the well to create an injection profile. The geotherm line 302 was measured previously, prior to injection. DTS temperature traces are shown for during injection (injection trace 304), as well as three subsequent shut-in times over a period of days. The three shut-in traces are identified as shut-in trace 1 306, shut-in trace 2 308 and shut-in trace 3 310 in FIG. 3. The shut-in traces 306, 308 and 310 together comprise a warm-back data set that may be used to model a pseudo-geotherm G*, as explained herein. Though 3 shut-in traces are shown in FIG. 3 by way of example, those of ordinary skill in the art will appreciate that more or fewer shut-in traces may be used in accordance with the present technological innovation.

Also shown in FIG. 3 is a calculated pseudo-geothermal trace G* 312. As explained herein, the trace G* 312 is calculated using the warm-back data set measured during shut-in, and represents an adjustment according to the present technological innovation to the geothermal trace G used in equation (1).

Figure 4:
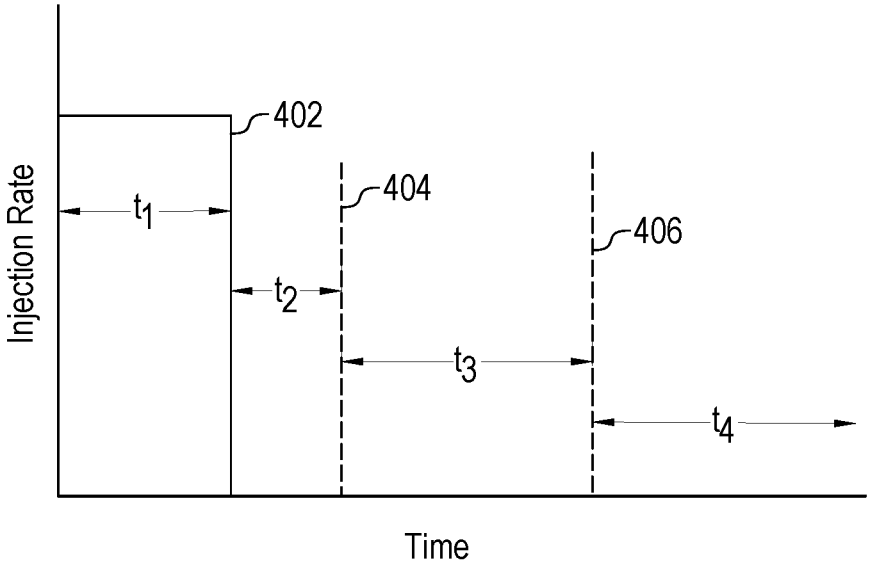
FIG. 4 is a graph showing an injection rate versus time for the various stages of an injection cycle in order to perform a warm-back analysis according to the present technological innovation.

FIG. 4 is a graph showing an injection rate versus time for the various stages of an injection cycle in order to perform a warm-back analysis according to the present technological innovation. The graph is generally referred to by the reference number 400.

The current technological innovation models heat transfer in the radial direction of the wellbore during a warm-back period using one-dimensional (1-D) energy equations. With regard to a timeline starting at the time fluid is injected into a wellbore, three distinct periods are identified in the present technological innovation. The first period is known as the early-time region (ETR), the second period is the middle-time region (MTR) and the third period is known as the late-time region (LTR). The identification of these three regions in conjunction with modeling according to the present technological innovation results in a temperature model that improves the relatively poor fit of previous techniques illustrated by equation (1). The ETR, MTR and LTR are graphically illustrated in FIG. 4.

In FIG. 4, $t_1$ is a period of steady injection of the well. The injection period ends at a time indicated by a line 402. Following this steady injection period, the injector well needs to be shut-in to allow performance of the warm-back analysis. The time window indicated by $t_2$ represents the ETR. Graphically, the ETR extends from the time indicated by the line 402 to a time indicated by a line 404. The ETR is the time period from fluid injection through the time when thermal effects from adiabatic expansion may be present in the region of the wellbore. In accordance with the present technological, the ETR is not considered in performing a warm-back analysis.

The time period $t_3$ represents the MTR. Graphically, the MTR extends from the time indicated by the line 404 to a time indicated by a line 406. The MTR is the warm-back period, during which one-dimensional (1-D) temperature recovery from the fluid injection takes place. The present technological innovation uses only data from the MTR in performing a warm-back analysis and calculating the pseudo-geothermal trace G*.

The time period $t_4$ represents the LTR. Graphically, the LTR extends forward in time from the line 406. The LTR is the period that begins when the effects of temperature changes from other zones may affect temperatures along the wellbore in a particular zone. Starting with the onset of the LTR, the 1-D modeling assumption is no longer valid due to inter-zone heat exchange. As explained herein, the present technological innovation allows the shut-in period of the well to end at the time indicated by the line 406, which represents the end of the MTR and the onset of the LTR. This reduction in shut-in time improves the efficiency of the well that is subject to the injection testing. Moreover, the well that is subject to the warm-back analysis may be returned to production at the onset of the LTR because no further data is needed for the warm-back analysis following the onset of the LTR.

The present technological innovation discards the temperature data from the ETR and LTR because data from those periods are not addressed in the 1-D model. Instead, the present technological innovation fits model parameters to the MTR. Using data derived from the MTR, model parameters at each depth are related directly to the volume of fluid injected in the corresponding zone and their relative values can be used to allocate injected fluid volumes. The asymptotic behavior of the middle-time warm-back that occurs in the MTR is used to infer the cumulative injection volume in each zone.

Figure 5:
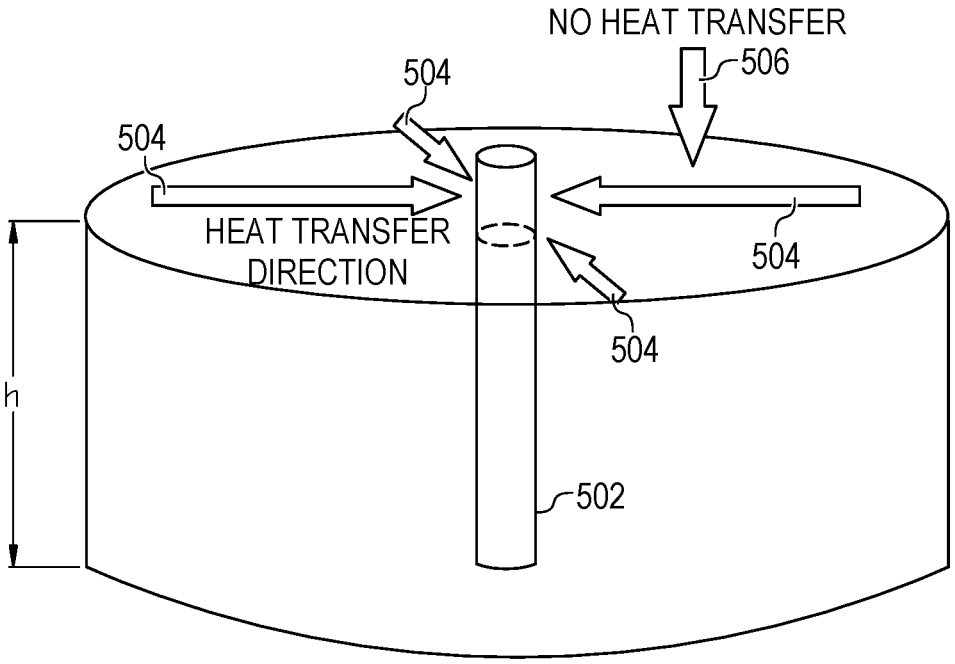
FIG. 5 is a drawing showing heat transfer along a wellbore during a middle-time region (MTR)

FIG. 5 is a drawing showing heat transfer along a wellbore during the MTR. The drawing is generally referred to by the reference number 500.

The drawing 500 shows a wellbore 502 that has been injected with fluid to perform a warm-back analysis according to the present technological innovation. Distance along the wellbore 502 in the longitudinal direction is shown by the variable h.

Arrows 504 indicate a direction of heat transfer during the MTR. As shown by the arrows 504, heat transfer during the MTR occurs radially towards the wellbore 502. An arrow 506 indicates that no heat transfer between zones occurs during the MTR.

During the MTR, the thermal gradient in the radial direction will be significantly higher than that between zones. This means that the majority of the heat transfer will happen in the radial direction, and the heat transfer between layers can be neglected.

Figure 6:
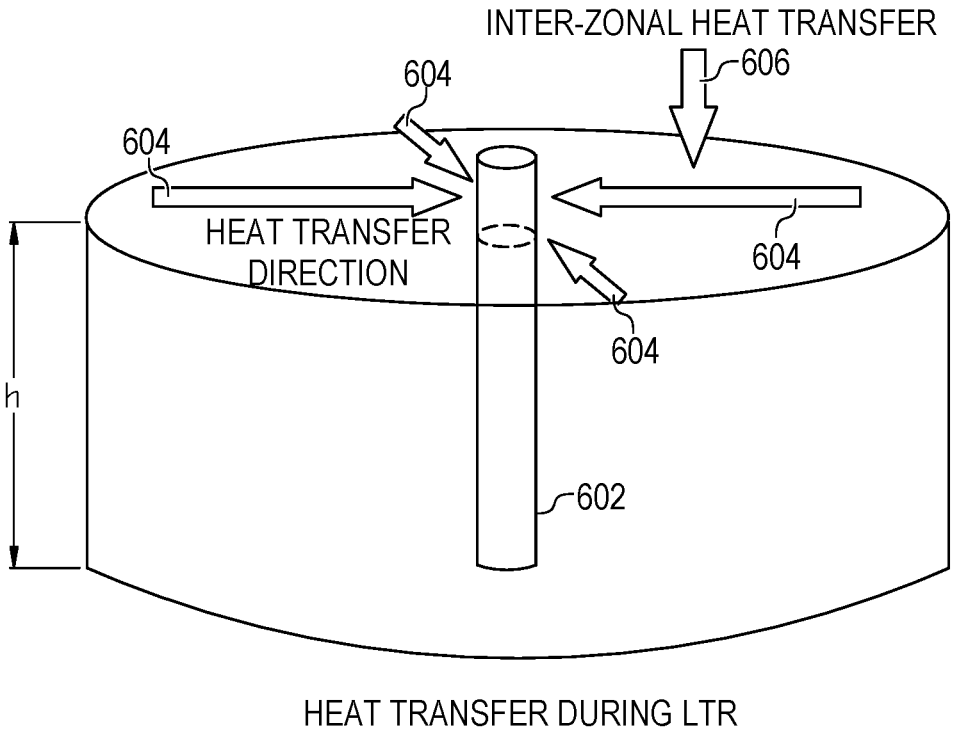
FIG. 6 is a drawing showing heat transfer along a wellbore during a late-time region (LTR)

FIG. 6 is a drawing showing heat transfer along a wellbore during the LTR. The drawing is generally referred to by the reference number 600. The drawing 600 is illustrative of conditions that occur after the condition shown in FIG. 5 (i.e., after the onset of the LTR).

The drawing 600 shows a wellbore 602 that has been injected with fluid to perform a warm-back analysis according to the present technological innovation. Distance along the wellbore 602 in the longitudinal direction is shown by the variable h.

Arrows 604 indicate a direction of heat transfer during the LTR. As shown by the arrows 604, heat transfer during the LTR occurs radially towards the wellbore 602. An arrow 606 indicates that heat transfer between zones does occur during the LTR.

During the LTR, once the wellbore 602 has warmed back significantly, the thermal gradient in the radial direction (shown by the arrows 604) and occurring between zones (shown by the arrow 606) will be comparable and thus, there will be comparable heat transfer radially and between zones. For this reason, the 1-D heat transfer assumption does not hold anymore and data from the LTR should be ignored.

According to the present technological innovation, warming from adjacent zones is what defines the LTR. As such, the MTR occurs when warming is radial (1-D) from the zone of a current point. Several neighbor points do comprise a single zone, but the next defined zone (adjacent to a given point) does not contribute warming to the present zone during the MTR.

The model of the present technological innovation is tuned to DTS temperature data from the warm-back using regression techniques applied independently at each depth. The technological innovation includes the introduction of G*, a near-well pseudo-geothermal temperature versus depth, resulting from subcooling to the original geotherm due to injection. G* represents a pseudo geothermal temperature, obtained by extending the model through only the MTR to infinite time. G* is the temperature to which the MTR-based model will asymptotically warm-back in the present shut-in period. G* is represented by the warm-back trace G* 312 in FIG. 3.

The present technological innovation comprises fitting a line using the original geotherm G (equation (1)) to the portion of the data in the MTR. Then, the prior known value of G is adjusted to cause the line to pass through the vertical axis at zero in a log-log plot. The result is the value of a calculated pseudo-geotherm G* for a specific warm-back. An equation for the calculated pseudo-geotherm G* may be derived from the basic warm-back equation shown as equation (1) above. Rearranging the terms of equation 1 and taking the log on both sides results in the following:

$$\log\frac{T_{well}-T_{inj}}{G-T_{inj}} = -\beta\log t_R. \qquad \text{Equation (2)}$$

There is a linear relationship between the logarithm of normalized temperature and log of dimensionless time and the straight-line passes through the vertical axis at zero (which means as $\Delta t \rightarrow$ Infinity, $T_{well} \rightarrow G$). However, when the regression model is fitted to only the linear portion of the MTR, it is noted that the line does not pass through the origin if the original G from the standard warm-back equation (1) is used (see FIG. 10). Moreover, the warm-back trace produced by equation (1) may be modified to take into account only data from the MTR. In this way, a log-log plot of the modified warm-back trace using a dimensionless time normalization will pass through the origin of the log-log graph (see FIG. 11). The fitted model matches the data only in the MTR. The modified (pseudo-geothermal) trace is G*.

The present technological innovation, in part, exploits the notion of fitting the calculated pseudo-geotherm G* and β (rather than just β as in equation (1)), to result in the following:

$$\log(T_{well}-T_{inj})=-\beta \log t_R+\log(G^*-T_{inj}) \quad \text{Equation (3).}$$

Using the temperature-time data, the middle portion of data is fitted to this linear equation and the slope of the line results in β, while the intercept yields an estimate of G*.

In equation (3), β represents the slope of the fit line provided by the technological innovation. Moreover, β is related to the rate of warm-back. β may vary along the well with rock properties and well equipment thermal conductivity or heat capacity, and not only the relative injection volume into a particular zone.

Those of ordinary skill in the art will appreciate that the geothermal trace (G) and calculated pseudo-geotherm (G*) are representations of the far-field (background) temperature. The warm-back traces referred to herein represent the traces recorded between the injection temperature (cold) and gradually approaching the geotherm or pseudo-geotherm at infinite time. Moreover, the geotherm (G) and pseudo-geotherm (G*) are the theoretical "infinite time" realizations of the warm back, once heat exchange has ceased.

The present technological innovation provides for the identification of the beginning and the end of the MTR. The end of the MTR corresponds to the onset of the LTR. Identification of the beginning of LTR without having to wait for collection of additional data during LTR allows optimization of well shut-in time and minimization of injection well downtime. Once the data begin to diverge from linear (at the onset of LTR) in zones of interest, further shut-in will not add more information for the model, and represents an optimal time to resume injection, ending the shut-in of the well. Alternatively, once the data from the MTR provides a good (stable) estimation of the parameters β and G*, it may be possible to return the well to service prior to the end of the MTR and prior to the start of LTR, further optimizing the shut-in period. (i.e. as soon as a line can reasonably be fit to the MTR on the log-log plot).

As an additional benefit of the present technological innovation, the application of G-G* for zonal allocation gives an indication of cumulative injection for each zone over the injection lifetime of the well. Incremental differences in G* (e.g., G*(date 1)−G*(date 2)) give an indication of the incremental injection into each zone during the injection period between date 1 and date 2. Also, the loss of injectivity to a particular zone would result in G−G*(date 1) to be greater than G−G*(date 2) if injectivity is lost between date 1 and date 2.

Figure 7:
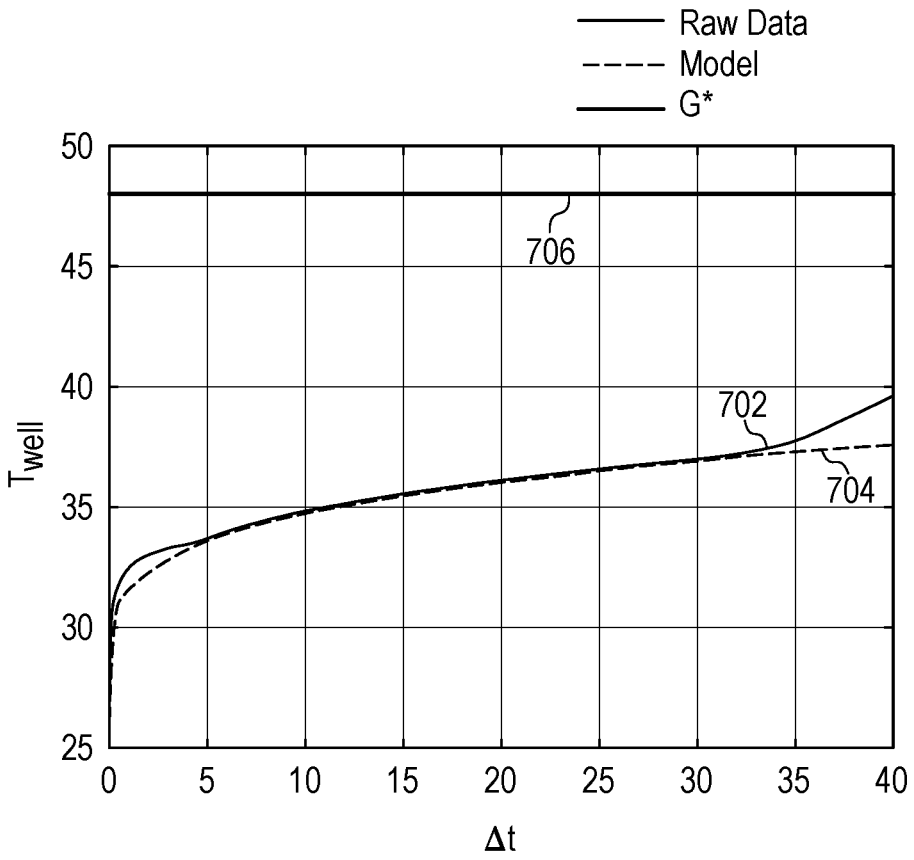
FIG. 7 is a graph showing an injector warm-back model according to the present technological innovation, with time plotted against temperature.

FIG. 7 is a graph showing an injector warm-back model according to the present technological innovation, with time plotted against temperature. The graph is generally referred to by the reference number 700.

The graph 700 includes a raw data trace 702. The raw data trace 702 shows actual temperature data obtained during shut-in from, for example, a DTS system.

The graph 700 also shows a model data trace 704. The model data trace 704 represents the warm-back that is predicted by the present technological innovation after the model is fitted to the MTR at a specific depth.

The graph 700 further shows a G* data trace 706. As explained herein, the G* data trace 706 represents the temperature to which the reservoir will warm back if the MTR is interpolated to infinite time at a specific depth.

Figure 8:
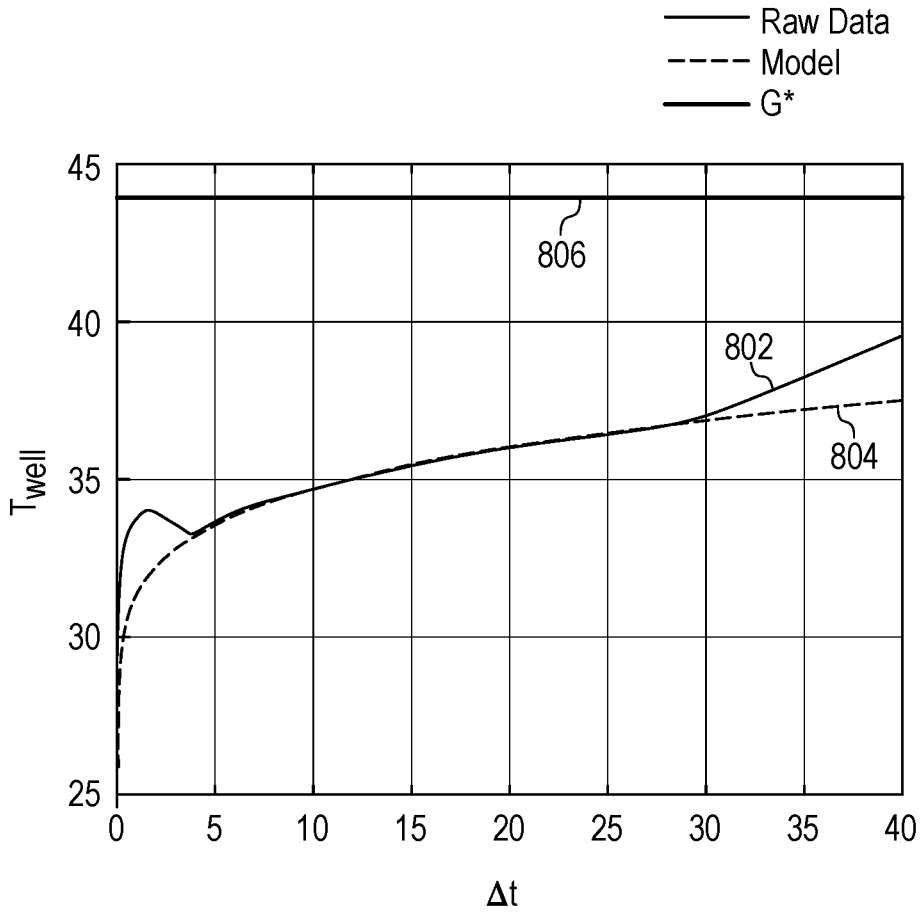
FIG. 8 is a graph showing an injector warm-back model according to the present technological innovation, with time plotted against temperature.

FIG. 8 is a graph showing an injector warm-back model according to the present technological innovation, with time plotted against temperature. The graph is generally referred to by the reference number 800.

The graph 800 includes a raw data trace 802. The raw data trace 802 shows actual temperature data obtained during shut-in from, for example, a DTS system.

The graph 800 also shows a model data trace 804. The model data trace 804 represents the warm-back that is predicted by the present technological innovation after the model is fitted to the MTR at a specific depth.

The graph 800 further shows a G* data trace 806. As explained herein, the G* data trace 806 represents the temperature to which the reservoir will warm back if the MTR is interpolated to infinite time at a specific depth.

Figure 9:
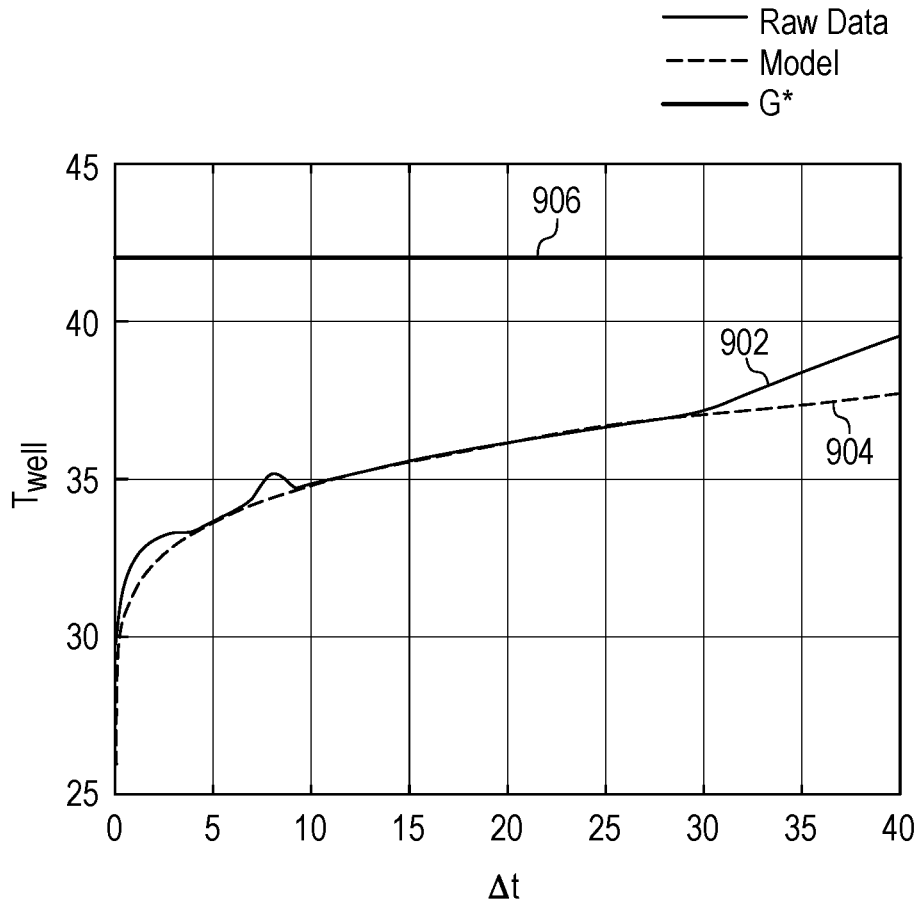
FIG. 9 is a graph showing an injector warm-back model according to the present technological innovation, with time plotted against temperature.

FIG. 9 is a graph showing an injector warm-back model according to the present technological innovation, with time plotted against temperature. The graph is generally referred to by the reference number 900.

The graph 900 includes a raw data trace 902. The raw data trace 902 shows actual temperature data obtained during shut-in from, for example, a DTS system.

The graph 900 also shows a model data trace 904. The model data trace 904 represents the warm-back that is predicted by the present technological innovation after the model is fitted to the MTR at a specific depth.

The graph 900 further shows a G* data trace 906. As explained herein, the G* data trace 906 represents the temperature to which the reservoir will warm back if the MTR is interpolated to infinite time at a specific depth.

Figure 10:
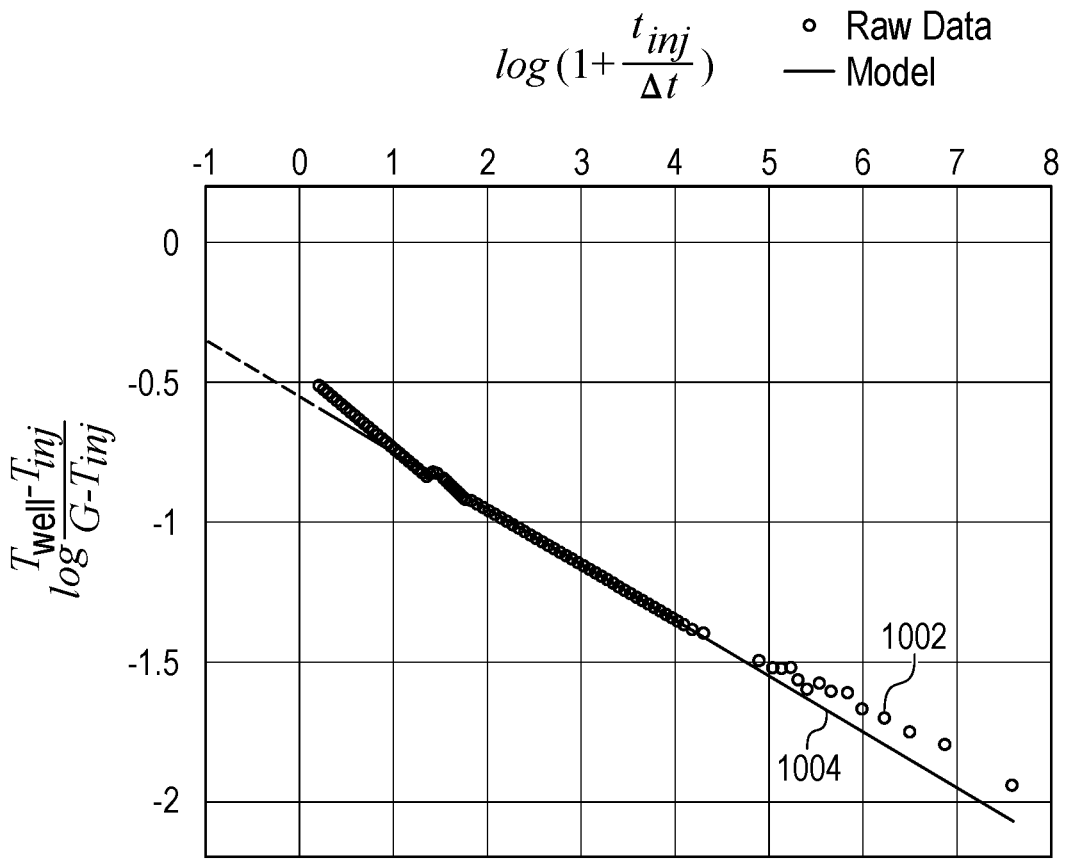
FIG. 10 is a graph showing an injector warm-back model with time plotted against temperature in a log-log manner and using a standard geotherm G.

FIG. 10 is a graph showing an injector warm-back model with time plotted against temperature in a log-log manner and using a standard geotherm G. The graph is generally referred to by the reference number 1000. The axes of the graph 1000 are dimensionless. This means that time and temperature as shown in FIG. 10 are expressed in terms of ratios.

The graph 1000 includes a raw data trace 1002. The raw data trace 1002 shows actual temperature data obtained during shut-in from, for example, a DTS system.

The graph 1000 also shows a model trace 1004. The model trace 1004 is calculated according to equation (1) using the original geotherm G, and data from the MTR. The model trace 1004 does not pass through the origin of the log-log plot shown in FIG. 10. The fact that the model trace 1004 does not pass through the origin illustrates the shortcoming of the model of G represented in equation (1).

Figure 11:
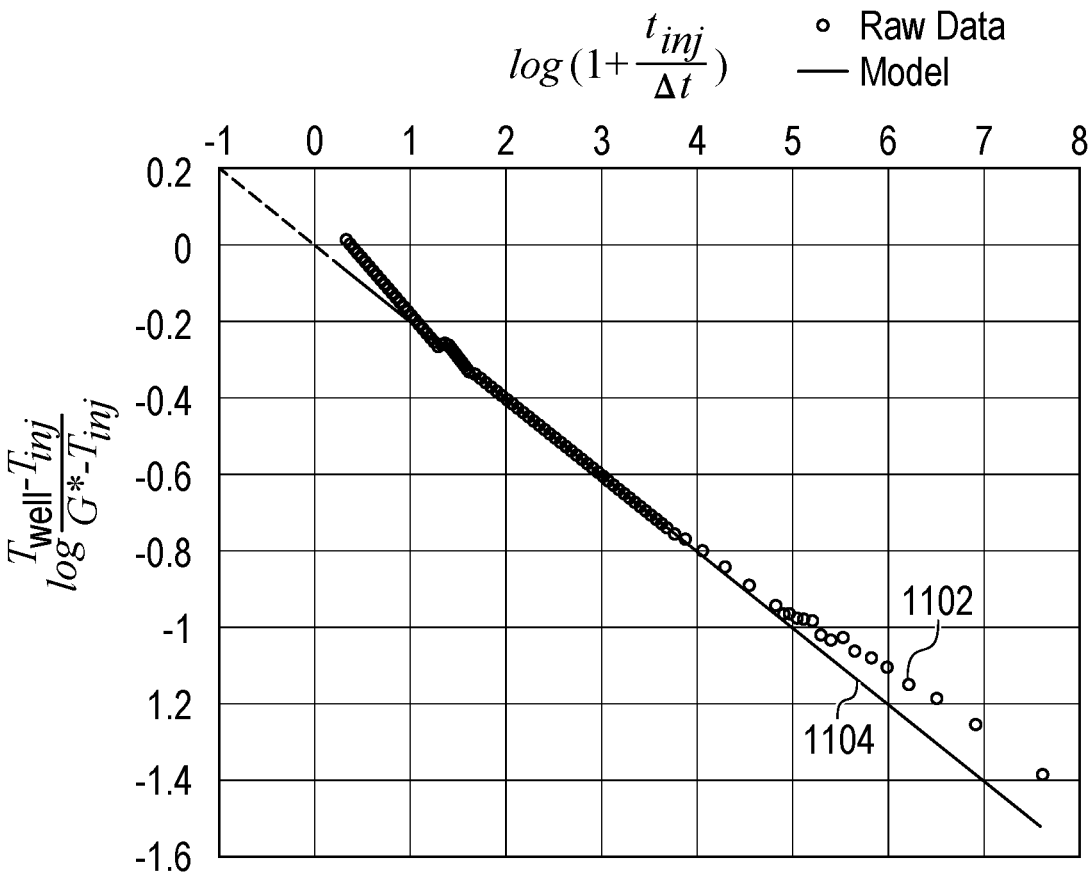
FIG. 11 is a graph showing an injector warm-back model with time plotted against temperature in a log-log manner and using a fitted pseudo-geotherm G* in accordance with the present technological innovation.

FIG. 11 is a graph showing an injector warm-back model with time plotted against temperature in a log-log manner and using a fitted pseudo-geotherm G* in accordance with the present technological innovation. The graph is generally referred to by the reference number 1100. The axes of the graph 1100 are dimensionless. This means that time and temperature as shown in FIG. 11 are expressed in terms of ratios.

The graph 1100 includes a raw data trace 1102. The raw data trace 1102 shows actual temperature data obtained during shut-in from, for example, a DTS system.

The graph 1100 also shows a model trace 1104. The model trace 1104 represents a modified pseudo-geotherm G* determined according to the present technological innovation. The model trace 1104 does pass through the origin of the log-log plot shown in FIG. 11.

Moving from right to left on the log-log plot 1100, as clock time would, the beginning of the MTR corresponds to the occurrence of a stable slope. According to the present technological innovation, identification of a stable slope of the warm-back temperature data, using a calculated pseudo-geotherm G* such that the model line passes through the origin, indicates the transition from the ETR to the beginning of the MTR. Moreover, a stable slope of this model line indicates that gathering further data likely will not improve the prediction of the calculated pseudo-geotherm G*. This property of G* may be used to determine that shut-in time and the gathering of warm-back data may be ended. In this way, the present technological innovation allows the optimization of the shut-in time in order to obtain sufficient data and return the injection well to service in an efficient manner.

Figure 12:
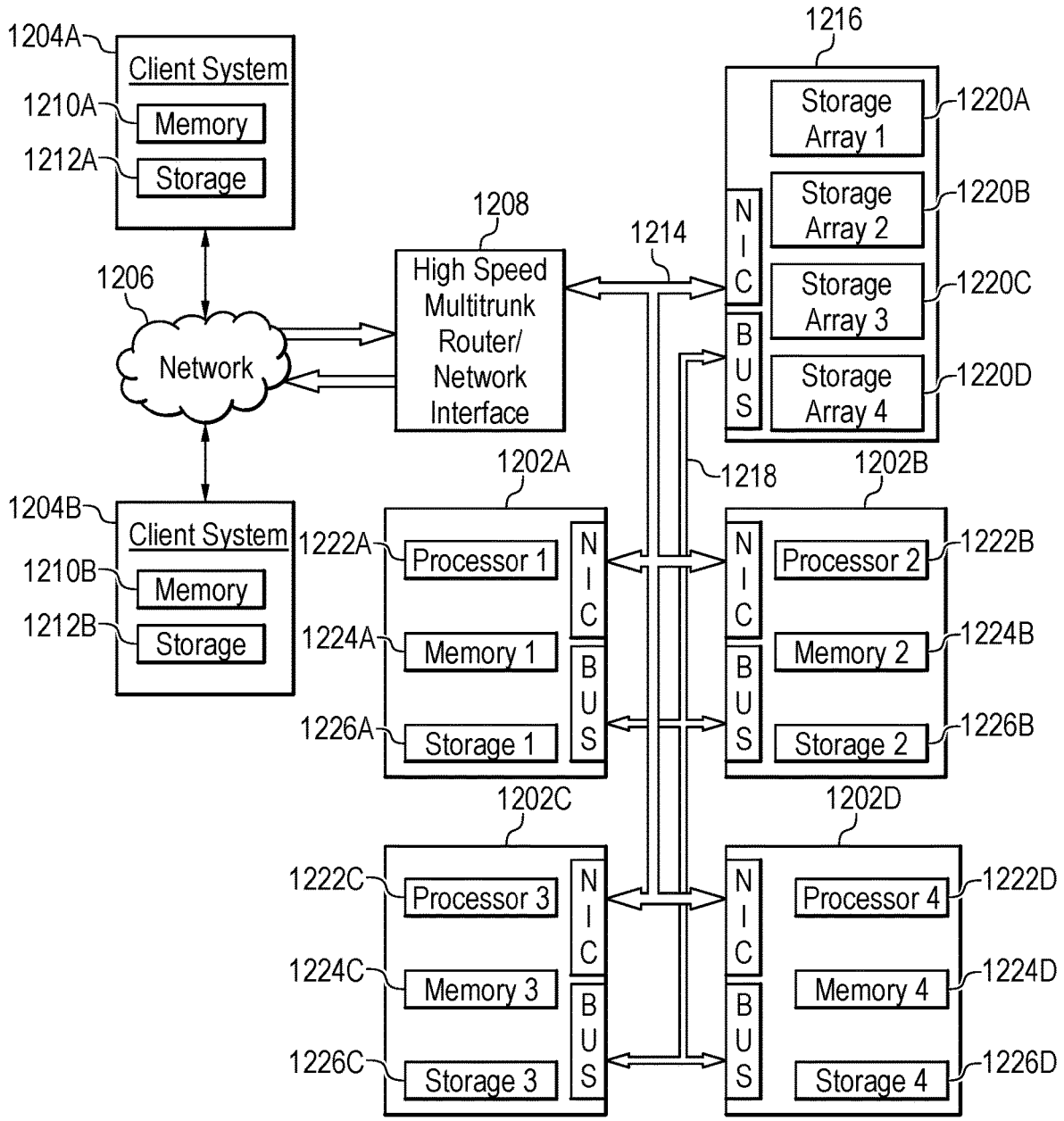
FIG. 12 is a block diagram of an exemplary cluster computing system that may be utilized to implement at least a portion of the present techniques.

FIG. 12 is a block diagram of an exemplary cluster computing system 1200 that may be utilized to implement at least a portion of the present techniques. The exemplary cluster computing system 1200 shown in FIG. 12 has four computing units 1202A, 1202B, 1202C, and 1202D, each of which may perform calculations for a portion of the present techniques. However, one of ordinary skill in the art will recognize that the cluster computing system 1200 is not limited to this configuration, as any number of computing configurations may be selected. For example, a smaller analysis may be run on a single computing unit, such as a workstation, while a large calculation may be run on a cluster computing system 1200 having tens, hundreds, thousands, or even more computing units.

The cluster computing system 1200 may be accessed from any number of client systems 1204A and 1204B over a network 1206, for example, through a high-speed network interface 1208. The computing units 1202A to 1202D may also function as client systems, providing both local computing support and access to the wider cluster computing system 1200.

The network 1206 may include a local area network (LAN), a wide area network (WAN), the Internet, or any combinations thereof. Each client system 1204A and 1204B may include one or more non-transitory, computer-readable storage media for storing the operating code and program instructions that are used to implement at least a portion of the present techniques, as described further with respect to the non-transitory, computer-readable storage media 1300 of FIG. 13, respectively. For example, each client system 1204A and 1204B may include a memory device 1210A and 1210B, which may include random access memory (RAM), read only memory (ROM), and the like. Each client system 1204A and 1204B may also include a storage device 1212A and 1212B, which may include any number of hard drives, optical drives, flash drives, or the like.

The high-speed network interface 1208 may be coupled to one or more buses in the cluster computing system 1200, such as a communications bus 1214. The communication bus 1214 may be used to communicate instructions and data from the high-speed network interface 1208 to a cluster storage system 1216 and to each of the computing units 1202A to 1202D in the cluster computing system 1200. The communications bus 1214 may also be used for communications among the computing units 1202A to 1202D and the cluster storage system 1216. In addition to the communications bus 1214, a high-speed bus 1218 can be present to increase the communications rate between the computing units 1202A to 1202D and/or the cluster storage system 1216.

In some embodiments, the one or more non-transitory, computer-readable storage media of the cluster storage system 1216 include storage arrays 1220A, 1220B, 1220C and 1220D for the storage of models (including the hybrid machine learning model described herein), data (including the fracture-related data described herein, among other data used for implementing the present techniques), visual representations, results (such as graphs, charts, and the like used to convey results obtained using the present techniques), code, and other information concerning the implementation of at least a portion of the present techniques. The storage arrays 1220A to 1220D may include any combinations of hard drives, optical drives, flash drives, or the like.

Each computing unit 1202A to 1202D includes at least one processor 1222A, 1222B, 1222C and 1222D and associated local non-transitory, computer-readable storage media, such as a memory device 1224A, 1224B, 1224C and 1224D and a storage device 1226A, 1226B, 1226C and 1226D, for example. Each processor 1222A to 1222D may be a multiple core unit, such as a multiple core central processing unit (CPU) or a graphics processing unit (GPU). Each memory device 1224A to 1224D may include ROM and/or RAM used to store program instructions for directing the corresponding processor 1222A to 1222D to implement at least a portion of the present techniques. Each storage device 1226A to 1226D may include one or more hard drives, optical drives, flash drives, or the like. In addition, each storage device 1226A to 1226D may be used to provide storage for models, intermediate results, data, images, or code used to implement at least a portion of the present techniques.

The present techniques are not limited to the architecture or unit configuration illustrated in FIG. 12. For example, any suitable processor-based device may be utilized for implementing at least a portion of the embodiments described herein, including (without limitation) personal computers, laptop computers, computer workstations, mobile devices, and multi-processor servers or workstations with (or without) shared memory. Moreover, the embodiments described herein may be implemented, at least in part, on application specific integrated circuits (ASICs) or very-large-scale integrated (VLSI) circuits. In fact, those skilled in the art may utilize any number of suitable structures capable of executing logical operations according to the embodiments described herein.

Figure 13:
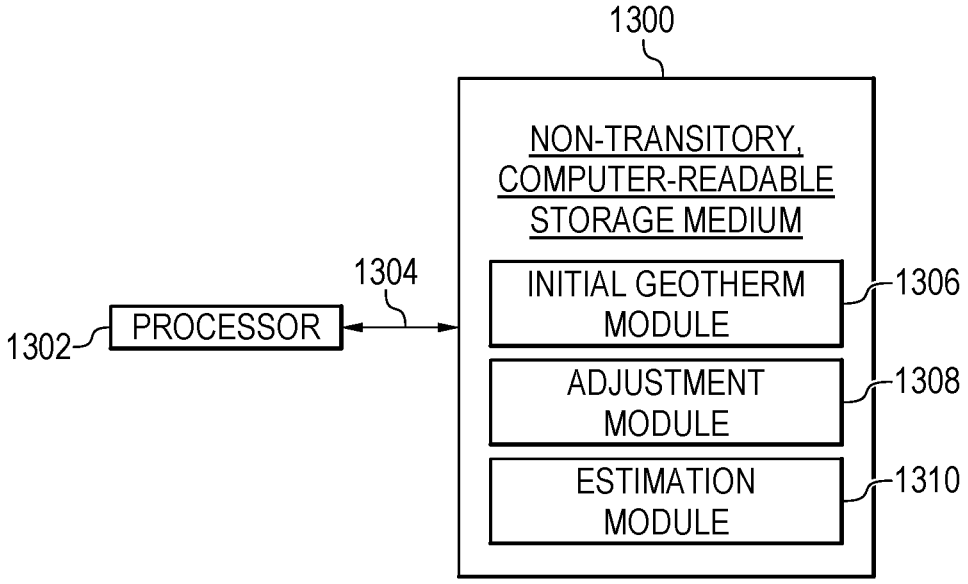
FIG. 13 is a block diagram of an exemplary non-transitory, computer-readable storage medium that may be used for the storage of data and modules of program instructions for implementing at least a portion of the present techniques.

FIG. 13 is a block diagram of an exemplary non-transitory, computer-readable storage medium 1300 that may be used for the storage of data and modules of program instructions for implementing at least a portion of the present techniques. The non-transitory, computer-readable storage medium 1300 may include a memory device, a hard disk, and/or any number of other devices, as described herein. A processor 1302 may access the non-transitory, computer-readable storage medium 1300 over a bus or network 1304. While the non-transitory, computer-readable storage medium 1300 may include any number of modules (and sub-modules) for implementing the present techniques, in some embodiments, the non-transitory, computer-readable storage medium 1300 includes an initial geotherm module 1306 for determining an initial geotherm (G) for a given depth and time based on a warm-back data set, as described herein. The initial geotherm may be representative of an estimate of a relative cumulative volume of fluid injected into multiple zones of an injection well located in a hydrocarbon reservoir. The injection well may include a plurality of zones. The initial geotherm may be based on a warm-back data set, as described herein.

The non-transitory, computer-readable storage medium 1300 includes an adjustment module 1308. The adjustment module 1308 adjusts the initial geotherm using only data in a middle-time region (MTR) after injection of the fluid into the wellbore, resulting in a calculated pseudo-geotherm (G*), as described herein according to embodiments of the current technological innovation.

The non-transitory, computer-readable storage medium 1300 includes an estimation module 1310. The estimation module 1310 estimates a volume of fluid injected into each of the plurality of zones based on the calculated pseudo-geotherm, as described herein according to embodiments of the current technological innovation.

In one or more embodiments, the present techniques may be susceptible to various modifications and alternative forms, such as the following embodiments as noted in paragraphs 1 to 22.

1. A method of estimating a relative cumulative volume of fluids injected into multiple zones of an injection well located in a hydrocarbon reservoir, the injection well including a plurality of zones, the method including: injecting fluid into a wellbore of the injection well; measuring temperature at points along the wellbore, to produce a warm-back data set that includes data for a plurality of times and depths; modifying an initial geotherm using only data from the warm-back data set that is in a middle-time region (MTR) of the warm-back data set to produce a calculated pseudo-geotherm; and estimating a volume of fluid injected into each of the plurality of zones based on the calculated pseudo-geotherm.

2. The method of paragraph 1, wherein the MTR at a given point occurs after a period of adiabatic warming at the given point and before warming from at least one of the plurality of zones adjacent to the zone defined by the given point.

3. The method of paragraph 1 or 2, wherein the warm-back data set in the MTR at a given point excludes data from an early-time region (ETR) prior to the MTR and data from a late-time region (LTR) that follows the MTR.

4. The method of any of paragraphs 1 to 3, wherein the warm-back data set is fitted to the equation:

$$T_{well}=T_{inj}+(G-T_{inj})t_R^{-\beta}$$

where $T_{well}$ is defined as a temperature at the wellbore, $T_{inj}$ is defined as a temperature of the fluid, the initial geotherm G is a geothermal temperature, and β is defined as an exponential fitting parameter, and where $t_R$ is a shut-in time ratio defined according to the equation:

$$t_R=(1+t_{inj}/\Delta t).$$

5. The method of any of paragraphs 1 to 4, wherein the calculated pseudo-geotherm (G*) is computed by fitting the warm-back data set to the equation:

$$\log(T_{well}-T_{inj})=-\beta \log t_R+\log(G^*-T_{inj})$$

where $T_{well}$ is defined as a temperature at the wellbore, $T_{inj}$ is defined as a temperature of the fluid, calculated pseudo-geotherm (G*) is defined as a near-well pseudo-geothermal temperature versus depth, $t_R$ is defined as a shut-in time ratio, and β is defined as an exponential fitting parameter.

6. The method of any of paragraphs 1 to 5, wherein the initial geotherm (G) does not cross an origin point when illustrated as dimensionless time versus dimensionless temperature graphed in a log-log manner.

7. The method of any of paragraphs 1 to 6, wherein the calculated pseudo-geotherm is fitted to cross an origin point when illustrated as dimensionless time versus dimensionless temperature graphed in a log-log manner.

8. The method of any of paragraphs 1 to 7, wherein a stable slope of data in the warm-back data set fit to a model line on a log-log plot indicates a beginning of the MTR.

9. The method of any of paragraphs 1 to 8, wherein an end of the MTR is indicated when data in the warm-back data set begins to deviate from a model line graphed on a log-log plot at later times.

10. The method of any of paragraphs 1 to 9, including optimizing a shut-in time during which the warm-back data set is used to identify a beginning of the MTR and ending the shut-in time as soon as a stable slope can be defined for a model on a log-log plot during the MTR.

11. A system for estimating a relative cumulative volume of fluids injected into multiple zones of an injection well located in a hydrocarbon reservoir, the injection well including a plurality of zones, the system including: an injection system that injects fluid into a wellbore of the injection well; a temperature measurement system that measures temperature at points along the wellbore at a plurality of times and depths to create a warm-back data set; and a computing system that: (i). determines an initial geotherm based on the warm-back data set; (ii) adjusts the initial geotherm using only data from the warm-back data set that is in a middle-time region (MTR) after injection of the fluid into the wellbore, resulting in a calculated pseudo-geotherm; and (iii) estimates a volume of fluid injected into each of the plurality of zones based on the initial geotherm (G) and the calculated pseudo-geotherm (G*).

12. The system of paragraph 11, wherein the MTR at a given point occurs after a period of adiabatic warming at the given point and before warming from at least one of the plurality of zones adjacent to the zone defined by the given point.

13. The system of paragraph 11 or 12, wherein data in the MTR at a given point excludes data from an early-time region (ETR) prior to the MTR and data from a late-time region (LTR) that follows the MTR.

14. The system of any of paragraphs 11 to 13, wherein the computing system computes the initial geotherm by fitting data from the warm-back data set for the MTR to the equation:

$$T_{well}=T_{inj}+(G-T_{inj})t_R^{-\beta}$$

where $T_{well}$ is defined as a temperature at the wellbore, $T_{inj}$ is defined as a temperature of the fluid, initial geotherm G is a geothermal temperature, β is defined as an exponential fitting parameter, and where $t_R$ is a shut-in time ratio defined according to the equation:

$$t_R=(1+t_{inj}/\Delta t).$$

15. The system of any of paragraphs 11 to 14, wherein the computing system computes the calculated pseudo-geotherm by fitting the warm-back data set for the MTR to the equation:

$$\log(T_{well}-T_{inj})=-\beta \log t_R+\log(G^*-T_{inj})$$

where $T_{well}$ is defined as a temperature at the wellbore, $T_{inj}$ is defined as a temperature of the fluid, calculated pseudo-geotherm G* is defined as a near-well pseudo-geothermal temperature versus depth, $t_R$ is defined as a shut-in time ratio, and β is defined as an exponential fitting parameter.

16. The system of any of paragraphs 11 to 15, wherein the initial geotherm G does not cross an origin point when illustrated as dimensionless time versus dimensionless temperature graphed in a log-log manner.

17. The system of any of paragraphs 11 to 16, wherein the calculated pseudo-geotherm G* is fitted to cross an origin point when illustrated as dimensionless time versus dimensionless temperature graphed in a log-log manner.

18. A computing system, including: a processor; and a non-transitory, computer-readable storage medium, including code configured to direct the processor to: determine an initial geotherm for a given depth and time, from a warm-back data set, with a rate of warm-back representative of an estimate of a relative cumulative volume of fluid injected into multiple zones of an injection well located in a hydrocarbon reservoir, the injection well including a plurality of zones, the warm-back data set being based on measured temperature at points along the wellbore at a plurality of times and depths; adjust the initial geotherm using only data from the warm-back data set that represents a middle-time region (MTR) after injection of the fluid into the wellbore, resulting in a calculated pseudo-geotherm; and estimate a volume of fluid injected into each of the plurality of zones based on the initial geotherm and the calculated pseudo-geotherm.

19. The computing system of paragraph 18, wherein the MTR at a given point occurs after a period of adiabatic warming at the given point and before warming from at least one of the plurality of zones adjacent to the zone defined by the given point.

20. The computing system of paragraph 18 or 19, wherein data in the MTR at a given point excludes data from an early-time region (ETR) prior to the MTR and data from a late-time region (LTR) that follows the MTR.

21. The computing system of any of paragraphs 18 to 20, wherein the initial geotherm (G) is computed according to the equation:

$$T_{well}=T_{inj}+(G-T_{inj})t_R^{-\beta}$$

where $T_{well}$ is defined as a temperature at the wellbore, $T_{inj}$ is defined as a temperature of the fluid, initial geotherm G is a geothermal temperature, β is defined as an exponential fitting parameter, and where $t_R$ is a shut-in time ratio defined according to the equation:

$$t_R=(1+t_{inj}/\Delta t).$$

22. The computing system of any of paragraphs 18 to 21, wherein the calculated pseudo-geotherm (G*) is computed according to the equation:

$$\log(T_{well}-T_{inj})=-\beta \log t_R+\log(G^*-T_{inj})$$

where $T_{well}$ is defined as a temperature at the wellbore, $T_{inj}$ is defined as a temperature of the fluid, calculated pseudo-geotherm G* is defined as a near-well pseudo-geothermal temperature versus depth, $t_R$ is defined as a shut-in time ratio, and β is defined as an exponential fitting parameter.

23. The computing system of any of paragraphs 18 to 22, wherein the calculated pseudo-geotherm G* is fitted to cross an origin point when illustrated as dimensionless time versus dimensionless temperature graphed in a log-log manner.

While the embodiments described herein are well-calculated to achieve the advantages set forth, it will be appreciated that such embodiments are susceptible to modification, variation, and change without departing from the spirit thereof. In other words, the particular embodiments described herein are illustrative only, as the teachings of the present techniques may be modified and practiced in different but equivalent manners apparent to those skilled in the art having the benefit of the teachings herein. Moreover, the systems and methods illustratively disclosed herein may suitably be practiced in the absence of any element that is not specifically disclosed herein and/or any optional element disclosed herein. While compositions and methods are described in terms of "comprising" or "including" various components or steps, the compositions and methods can also "consist essentially of" or "consist of" the various components and steps. Indeed, the present techniques include all alternatives, modifications, and equivalents falling within the true spirit and scope of the appended claims.

What is claimed is:

1. A method of estimating a relative cumulative volume of fluids injected into multiple zones of an injection well located in a hydrocarbon reservoir, the injection well including a plurality of zones, the method comprising:

injecting fluid into a wellbore of the injection well;

measuring temperature at points along the wellbore, to produce a warm-back data set that includes data for a plurality of times and depths;

modifying an initial geotherm G using only the data from the warm-back data set that is in a middle-time region (MTR) of the warm-back data set to produce a calculated pseudo-geotherm G*; and estimating a volume of the fluid injected into each of the plurality of zones based on the calculated pseudo-geotherm G*.

2. The method of claim 1, wherein the MTR at a given point occurs after a period of adiabatic warming at the given point and before warming from at least one of the plurality of zones adjacent to a zone defined by the given point.

3. The method of claim 1, wherein the data in the MTR of the warm-back data set at a given point excludes the data from an early-time region (ETR) prior to the MTR and the data from a late-time region (LTR) that follows the MTR.

4. The method of claim 1, wherein the warm-back data set is fitted to equation:

$$T_{well}=T_{inj}+(G-T_{inj})t_R^{-\beta}$$

where $T_{well}$ is defined as a temperature at the wellbore, $T_{inj}$ is defined as a temperature of the fluid, the initial geotherm G is a geothermal temperature, and β is defined as an exponential fitting parameter, and where $t_R$ is a shut-in time ratio defined according to equation:

$$t_R=(1+t_{inj}/\Delta t)$$

where $t_{inj}$ is a time duration of injection prior to a shut-in and is Δt is a time elapsed.

5. The method of claim 1, wherein the calculated pseudo-geotherm G* is computed by fitting the warm-back data set to equation:

$$\log(T_{well}-T_{inj})=-\beta \log t_R+\log(G^*-T_{inj})$$

where $T_{well}$ is defined as a temperature at the wellbore, $T_{inj}$ is defined as a temperature of the fluid, the calculated pseudo-geotherm G* is defined as a near-well pseudo-geothermal temperature versus depth, $t_R$ is defined as a shut-in time ratio, and β is defined as an exponential fitting parameter.

6. The method of claim 1, wherein the initial geotherm G does not cross an origin point when illustrated as dimensionless time versus dimensionless temperature graphed in a log-log manner.

7. The method of claim 1, wherein the calculated pseudo-geotherm G* is fitted to cross an origin point when illustrated as dimensionless time versus dimensionless temperature graphed in a log-log manner.

8. The method of claim 1, wherein a stable slope of the data in the warm-back data set fit to a model line on a log-log plot indicates a beginning of the MTR.

9. The method of claim 1, wherein an end of the MTR is indicated when the data in the warm-back data set begins to deviate from a model line graphed on a log-log plot at later times.

10. The method of claim 1, comprising optimizing a shut-in time during which the warm-back data set is used to identify a beginning of the MTR and ending the shut-in time as soon as a stable slope can be defined for a model on a log-log plot during the MTR.

11. A system for estimating a relative cumulative volume of fluids injected into multiple zones of an injection well located in a hydrocarbon reservoir, the injection well including a plurality of zones, the system comprising:

an injection system that injects fluid into a wellbore of the injection well;

a temperature measurement system that measures temperature at points along the wellbore at a plurality of times and depths to create a warm-back data set; and a computing system that:

(i) determines an initial geotherm G based on the warm-back data set;

(ii) adjusts the initial geotherm G using only data from the warm-back data set that is in a middle-time region (MTR) after injection of the fluid into the wellbore, resulting in a calculated pseudo-geotherm G*; and (iii) estimates a volume of the fluid injected into each of the plurality of zones based on the initial geotherm G and the calculated pseudo-geotherm G*.

12. The system of claim 11, wherein the MTR at a given point occurs after a period of adiabatic warming at the given point and before warming from at least one of the plurality of zones adjacent to a zone defined by the given point.

13. The system of claim 11, wherein the data in the MTR at a given point excludes the data from an early-time region (ETR) prior to the MTR and the data from a late-time region (LTR) that follows the MTR.

14. The system of claim 11, wherein the computing system computes the initial geotherm G by fitting data from the warm-back data set for the MTR to equation:

$$T_{well}=T_{inj}+(G-T_{inj})t_R^{-\beta}$$

where $T_{well}$ is defined as a temperature at the wellbore, $T_{inj}$ is defined as a temperature of the fluid, the initial geotherm G is a geothermal temperature, β is defined as an exponential fitting parameter, and where $t_R$ is a shut-in time ratio defined according to equation:

$$t_R=(1+t_{inj}/\Delta t)$$

where $t_{inj}$ is a time duration of injection prior to a shut-in and is Δt is a time elapsed.

15. The system of claim 11, wherein the computing system computes the calculated pseudo-geotherm G* by fitting the warm-back data set for the MTR to equation:

$$\log(T_{well}-T_{inj})=-\beta \log t_R+\log(G^*-T_{inj})$$

where $T_{well}$ is defined as a temperature at the wellbore, $T_{inj}$ is defined as a temperature of the fluid, the calculated pseudo-geotherm G* is defined as a near-well pseudo-geothermal temperature versus depth, $t_R$ is defined as a shut-in time ratio, and β is defined as an exponential fitting parameter.

16. The system of claim 11, wherein the initial geotherm G does not cross an origin point when illustrated as dimensionless time versus dimensionless temperature graphed in a log-log manner.

17. The system of claim 11, wherein the calculated pseudo-geotherm G* is fitted to cross an origin point when illustrated as dimensionless time versus dimensionless temperature graphed in a log-log manner.

18. A computing system, comprising:

a processor; and a non-transitory, computer-readable storage medium, comprising code configured to direct the processor to:

determine an initial geotherm G for a given depth and time, from a warm-back data set, with a rate of warm-back representative of an estimate of a relative cumulative volume of fluid injected into multiple zones of an injection well located in a hydrocarbon reservoir, the injection well including a plurality of zones, the warm-back data set being based on measured temperature at points along a wellbore at a plurality of times and depths;

adjust the initial geotherm G using only data from the warm-back data set that represents a middle-time region (MTR) after injection of the fluid into the wellbore, resulting in a calculated pseudo-geotherm G*; and estimate a volume of the fluid injected into each of the plurality of zones based on the initial geotherm G and the calculated pseudo-geotherm G*.

19. The computing system of claim 18, wherein the MTR at a given point occurs after a period of adiabatic warming at the given point and before warming from at least one of the plurality of zones not adjacent to the given point.

20. The computing system of claim 18, wherein the data in the MTR at a given point excludes the data from an early-time region (ETR) prior to the MTR and the data from a late-time region (LTR) that follows the MTR.

21. The computing system of claim 18, wherein the initial geotherm G is computed according to equation:

$$T_{well}=T_{inj}+(G-T_{inj})t_R^{-\beta}$$

where $T_{well}$ is defined as a temperature at the wellbore, $T_{inj}$ is defined as a temperature of the fluid, the initial geotherm G is a geothermal temperature, β is defined as an exponential fitting parameter, and where $t_R$ is a shut-in time ratio defined according to equation:

$$t_R=(1+t_{inj}/\Delta t)$$

where $t_{inj}$ is a time duration of injection prior to a shut-in and is Δt is a time elapsed.

22. The computing system of claim 18, wherein the calculated pseudo-geotherm G* is computed according to equation:

$$\log(T_{well}-T_{inj})=-\beta \log t_R+\log(G^*-T_{inj})$$

where $T_{well}$ is defined as a temperature at the wellbore, $T_{inj}$ is defined as a temperature of the fluid, the calculated pseudo-geotherm G* is defined as a near-well pseudo-geothermal temperature versus depth, $t_R$ is defined as a shut-in time ratio, and β is defined as an exponential fitting parameter.

23. The computing system of claim 18, wherein the calculated pseudo-geotherm G* is fitted to cross an origin point when illustrated as dimensionless time versus dimensionless temperature graphed in a log-log manner.

* * * * *